US010758022B2

(12) United States Patent
Callicutt

(10) Patent No.: US 10,758,022 B2
(45) Date of Patent: Sep. 1, 2020

(54) MINI BRAKE FOR HAIR COLOR PLACEMENT FOILS AND ITS METHOD OF USE

(71) Applicant: Mary E. Callicutt, Surfside Beach, SC (US)

(72) Inventor: Mary E. Callicutt, Surfside Beach, SC (US)

( * ) Notice: Subject to any disclaimer, the term of this patent is extended or adjusted under 35 U.S.C. 154(b) by 0 days.

(21) Appl. No.: 15/408,353

(22) Filed: Jan. 17, 2017

(65) Prior Publication Data

US 2017/0224080 A1 Aug. 10, 2017

Related U.S. Application Data

(62) Division of application No. 14/572,506, filed on Dec. 16, 2014, now Pat. No. 9,549,601.

(51) Int. Cl.

| | |
|---|---|
| ***A45D 7/04*** | (2006.01) |
| ***A45D 19/00*** | (2006.01) |
| ***A45D 44/00*** | (2006.01) |
| ***A45D 44/02*** | (2006.01) |

(52) U.S. Cl.

CPC ..... *A45D 19/0025* (2013.01); *A45D 44/00* (2013.01); *A45D 44/02* (2013.01); *A45D 2019/0066* (2013.01); *A45D 2019/0091* (2013.01)

(58) Field of Classification Search

CPC ..... A45D 7/045; A45D 19/0016; A45D 19/0025; A41B 43/0257; A41B 43/025; A41B 43/00; B31B 1/48; B65H 45/00; B65H 45/12

IPC ..... A45D 7/05

See application file for complete search history.

(56) References Cited

U.S. PATENT DOCUMENTS 740,581 A * 10/1903 Maxson ..... B31D 1/04 493/458
3,326,365 A * 6/1967 Neureither ..... B31D 1/04 428/43
3,611,617 A * 10/1971 Foster et al. ..... A63H 33/16 428/542.8
3,666,607 A * 5/1972 Weissman ..... B65D 5/008 229/108
3,971,156 A * 7/1976 Lamlee ..... A63H 33/16 273/155
4,192,423 A * 3/1980 Rekow ..... B65D 81/056 206/586
4,348,449 A * 9/1982 Seufert ..... B29C 53/06 229/930
4,358,019 A * 11/1982 Garner ..... A47B 65/20 211/42
4,421,500 A * 12/1983 Smith ..... B65H 45/12 493/405

(Continued)

*Primary Examiner* — Cris L. Rodriguez
*Assistant Examiner* — Brianne E Kalach
(74) *Attorney, Agent, or Firm* — Ronald L. Hofer

(57) ABSTRACT

A hair folding and creasing brake device for creating pre-folded and creased triangular hair foils for dimensional hair color placement has a hinged sheet which is hinged so that foil sheets placed on its surface can be clamped and then bent to form a crease in the foil. A hair coloring foil is prepared by placing a foil or a pack of foils onto the device which is then folded over the foil to clamp the foil and then then folded again to bend the foil to impart a crease to the foil.

8 Claims, 3 Drawing Sheets

(56) References Cited

U.S. PATENT DOCUMENTS

| | | | | | |
|---|---|---|---|---|---|
| 4,865,579 | A * | 9/1989 | Kirby | B31D 1/04 | 493/458 |
| 5,225,254 | A * | 7/1993 | Foulke | E01F 9/654 | 116/63 C |
| 5,417,641 | A * | 5/1995 | Warren | B65B 25/20 | 493/405 |
| 5,570,906 | A * | 11/1996 | Giulie | B42B 5/00 | 281/21.1 |
| 7,789,381 | B2 * | 9/2010 | Dunn | A45D 19/00 | 270/52.07 |
| 8,142,341 | B1 * | 3/2012 | Salvesen | A45D 19/00 | 493/356 |
| 2008/0257370 | A1 * | 10/2008 | Perry | A45D 19/0025 | 132/200 |
| 2011/0009252 | A1 * | 1/2011 | Cleveland | B65H 45/12 | 493/406 |

* cited by examiner

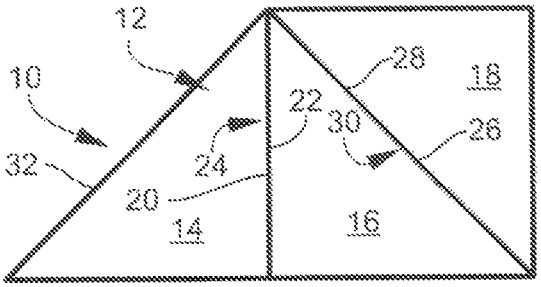
FIG. 1
FIG. 2
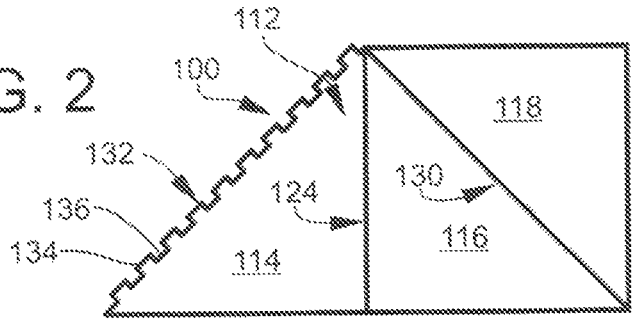
FIG. 3
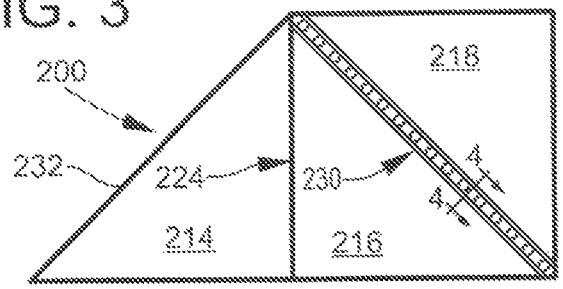
FIG. 4
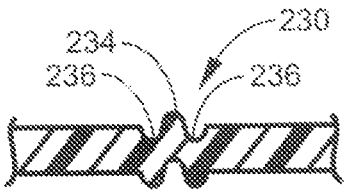
FIG. 5
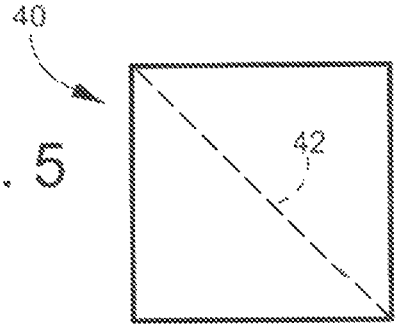
FIG. 6
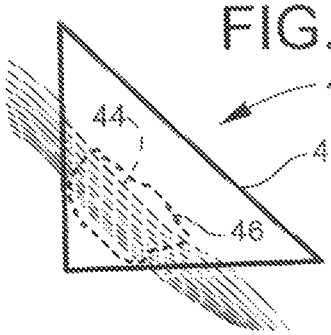

MINI BRAKE FOR HAIR COLOR PLACEMENT FOILS AND ITS METHOD OF USE

FIELD OF THE INVENTION

The present invention relates to hair coloring in salons and the like. More particularly, the present invention relates to a small brake device and to its method of use for manually creasing triangular hair foils for their subsequent use in dimensional hair color placement.

BACKGROUND OF THE INVENTION

Thin rectangular sheets of aluminum foil, referred to as "hair foils," are commonly used by professional hair colorists and hair stylists to color or highlight the hair of customers in hair salons. Each rectangular hair foil is used to form a "packet" which is locked in place into a selected hair section with a lock of hair and a desired coloring composition. As many as fifty or more hair foils may be required to color a single head of hair. A busy hair colorist will use thousands of hair foils in a week.

Conventional rectangular or square hair foils are supplied to hair salons in stacks of flat foil sheets often separated by paper sheets. Hair foils are also sold as a pop-up style and in the form of continuous rolls of foil with a cutter to cut a custom length of foil chosen by the colorist. Many colorists simply work with what are commonly referred to as potato wrap foils.

Conventional rectangular or square hair foils require multiple folds to lock the foil packet with coloring product into the selected hair section. Thus, during its use as a hair foil, each foil sheet is folded at least once and usually multiple times by the hair colorist to form a pocket for the lock of hair and coloring composition. To facilitate this step the foil sheets are prepared before the hair coloring procedure begins by cutting to size and/or creasing a plurality of sheets. This makes it easier for the hair colorist to use them during the hair coloring procedure.

The preparation of hair foils is time consuming and tedious work and there have been efforts to mechanize the process. For example, U.S. Pat. No. 7,062,947, Jun. 20, 2006 to James Douglas Farfor for CUTTING AND FOLDING MACHINE discloses a cutting and folding machine for cutting foil from a sheet into rectangular pieces with one edge folded over to provide reinforcement along that edge. U.S. Pat. No. 8,387,432, Mar. 5, 2013 TO Ross et al, for METHOD AND APPARATUS FOR DISPENSING SHEETS OF FOIL discloses a machine for automatically dispensing sheets of foil ready for use in coloring hair.

However, machines are relatively expensive and may not be available to the hair colorist. Therefore, there remains a need for an improved and economical device for manual preparation of foils for hair color placement which will facilitate the preparation and use of the foils during the hair coloring process. There also remains a need for an improved hair coloring procedure. Accordingly, the present invention provides a small brake device for creasing triangular hair foils and a method of their use which offers several advantages over traditional rectangular or square hair foils.

Whereas conventional hair foils require multiple folds to lock the foil packet with product into the selected hair section, the triangular hair foils of the present invention require only a single fold to lock the foil packet into place. This single locking fold of the triangular foil allows for quicker and cleaner release from the hair than the multiple locking folds required by a rectangular foil. Additionally, triangular foils allow for the treated hair section to be placed farther into the body of the packet, away from the foil crease, keeping the product on the selected section of hair and decreasing the possibility of uneven product saturation and product displacement that can result from the multiple folds of rectangular foils pushing the product away from the hair section, thereby avoiding what is known in the industry as lines of demarcation. By placing the crease of the triangular foils parallel to the temporal hair line, the packets of product and treated hair are kept out of the client's eyes and face as the packets are folded, closed and directed away from the face, keeping chemicals away from the customer's face. This technique also provides a more professional presentation on the part of the colorist than allowed by traditional rectangular foils.

The present invention is directed to a device for manual preparation of triangular hair color placement foils and to their method of use. In accordance with the present invention the device can be provided at little expense yet is practical and will facilitate the preparation of triangular foils to make the life of the hair coloring user much easier. Use of triangular hair foils allows coverage of more head surface in a shorter time than use of conventional rectangular foils. Triangular foils also can be easily directed away from the face of the client and provide a more attractive, finished look during the coloring process.

Further understanding of the present invention will be had from the following description and claims taken in conjunction with the accompanying drawings.

BRIEF DESCRIPTION OF THE DRAWINGS

FIG. 1 is a top plan view of a preferred embodiment of the present invention;

FIG. 2 is a top plan view of an alternative preferred embodiment of the present invention;

FIG. 3 is a top plan view of another alternative preferred embodiment of the present invention;

FIG. 4 is a sectional view taken along line 4-4 in FIG. 3;

FIG. 5 is a top plan view of a hair foil prepared in accordance with a preferred embodiment of a method of the present invention;

FIG. 6 is a top plan view of the hair foil of FIG. 2 folded and shown in use with a lock of hair and coloring composition;

SUMMARY OF THE INVENTION

Figure 7:
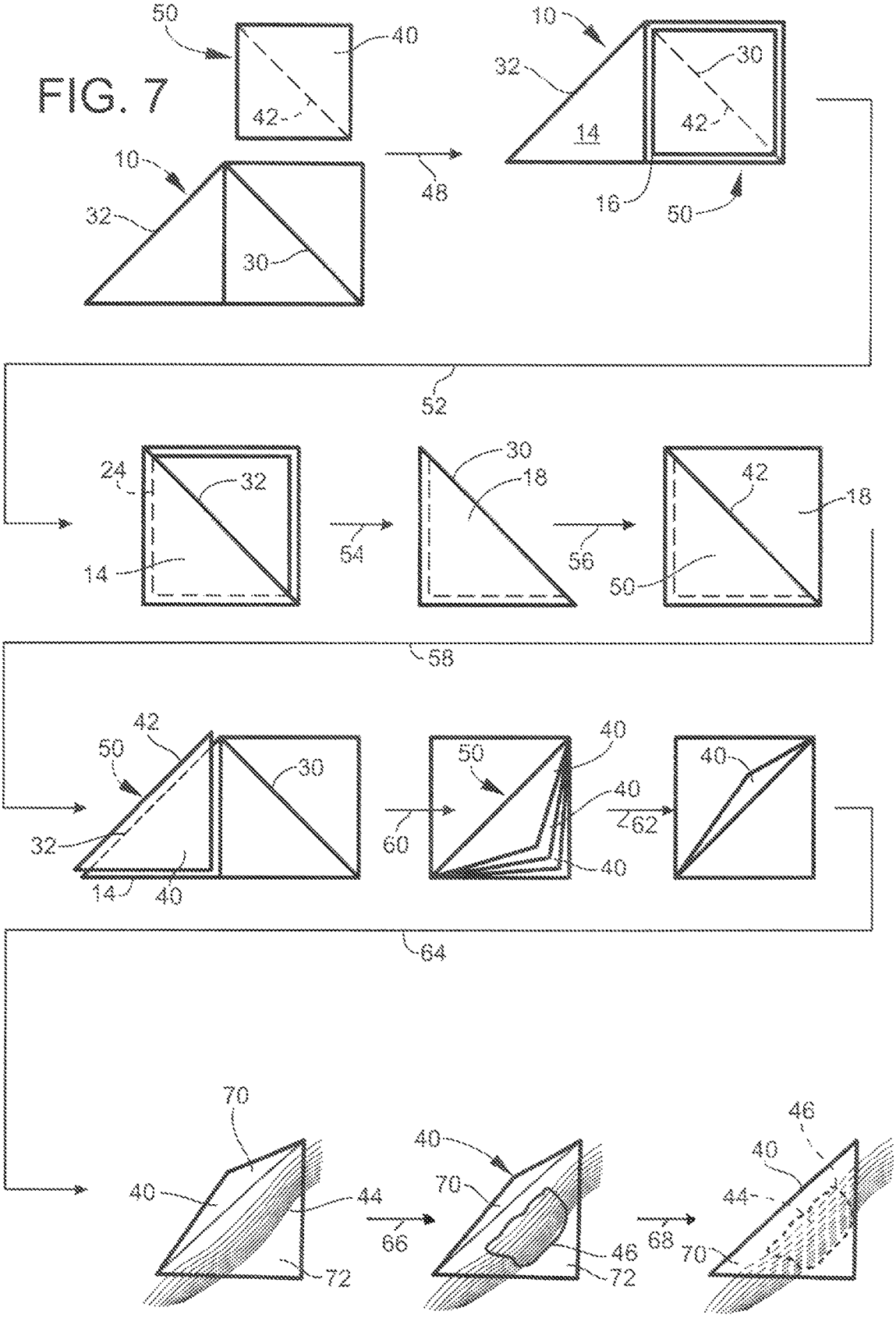
FIG. 7 is a sequential top plan view illustrating the steps of a preferred embodiment of a method of use of the preferred embodiment shown in FIG. 1.

A hair folding and creasing brake device for creating pre-folded and creased triangular hair foils for dimensional hair color placement comprises a sheet which is hinged so that foil sheets placed on its surface can be clamped and then bent to form a crease therein. In plan view, a preferred embodiment of a brake of the present invention has three congruent isosceles right triangles, two of which are hingedly joined along their respective hypotenuses and a third of which is joined to one of the two along their respective legs. A hair coloring foil is prepared by placing a foil or a pack of foils onto the square formed by the two isosceles right triangles which are joined at their hypotenuses, then folding the third triangle over the foil to clamp the foil and then then folding the free right triangle over the third right triangle to thereby bend the foil along the joined hypotenuses.

DESCRIPTION OF THE INVENTION

Broadly speaking, a preferred embodiment of the present invention is a hair folding and creasing brake device for creating creased triangular hair foils for dimensional hair color placement. The hair foil brake comprises a sheet which is hinged so that foil sheets placed on its surface can be clamped and then bent to form pre-triangular foils from square foil sheets.

Now referring to FIG. 1, a preferred embodiment of a hair foil brake of the present invention is shown and indicated generally by the numeral 10. Hair foil brake 10 is a hinged sheet 12 comprising, in plan view, first, second and third isosceles right triangles, 14, 16 and 18. Triangular sheet 14 has a leg 20 hingedly joined to leg 22 of triangular sheet 16 to form clamping joint 24. Triangular sheet 16 has hypotenuse 26 joined to hypotenuse 28 of triangular sheet 18 to form bending joint 30. The length of leg 20 is preferably about 4 to about 5 inches, depending upon the desired size of hair foil sheets to be creased thereby. Thus, for creasing 4 inch square hair foil sheets, leg 20 is preferably about 4 inches in length, i.e., leg 20 preferably corresponds to the size of the square hair foil sheet to be creased.

It is intended that sheet 12 can be made of a single sheet of thin polymeric material with joints 24 and 30 being "live" hinges formed therein by any conventional means. Alternatively, sheet 12 can comprise three separate triangular sheets which are joined together at 24 and 30 by any other type of hinge which achieves the purpose of the present invention. Sheet 12 can be a thin sheet of less than a millimeter or a thick sheet of up to 20 millimeters or so, the thickness of sheet 12 being limited only by its requirement to successfully function to clamp and crease hair foil sheets. Of course, while it is contemplated that sheet 12 will be comprised of a suitable polymeric material such as nylon, polyester or the like, it can be comprised of any suitable material including metals or even paper.

FIGS. 2 to 4 show alternative preferred embodiments of a mini brake of the present invention which are provided with features to enhance the crease imparted to hair foil sheets by the mini brake. Thus, as shown in FIG. 4, mini brake 100 is generally analogous to mini brake 10, being a hinged sheet 112 having first, second and third isosceles right triangles 114, 116, and 118, clamping joint 124 and bending joint 130. However, brake 100 has a folding edge 132 provided with a plurality of teeth 134 projecting from valleys 132 to impart corresponding indentations into hair foil sheets during its use to further enhance creases therein to facilitate folding of the sheets.

FIGS. 3 and 4 illustrate mini brake 200 which is generally analogous to mini brake 10, being a hinged sheet 212 having first, second and third isosceles right triangles 214, 216, and 218, clamping joint 224 and bending joint 230. However, brake 200 has a bending joint 230 provided with spaced apart projections 234 and valleys 236 to impart corresponding indentations into foil sheets during its use to further enhance creases therein to facilitate folding of the sheets.

As will be described in more detail below, a hair foil brake of this invention is intended for use to impart a crease to each of a pack of square hair foils to facilitate their individual use as triangular packets. Brakes 10, 100 or 200 are each well suited for this purpose it being understood that in the following description brake 100 or 200 can be substituted for brake 10.

A suitable starting hair foil square for use with hair foil brake 10 is illustrated in FIG. 5, and indicated generally by the numeral 40. As shown in FIG. 5, hair foil 40 is shown in plan view and is a conventional square hair foil sheet comprised of aluminum and is illustrated before being prepared for use by brake 10 in accordance with the present invention. Hair foil 40 is preferably about 4 to about 5 inches square which allows for the best horizontal, diagonal or vertical placement of triangular foils on a person's head. Dashed line 42 extending from one corner to the opposite corner of hair foil 40 indicates approximately where the crease line will be imparted to hair foil 40 by hair foil brake 10. Packs of hair foils separated by paper sheets and suitable for use in the present invention include 0.0006 inch florist foil/highlighting foil available commercially from Alufoil Products Co., Hauppauge, N.Y. Of course, other hair foil sheets of various thicknesses and from other suppliers can also be used. For example, foil sheets may be supplied in a pop up style or as a continuous roll of foil which is then cut to provide each foil sheet. Potato wrap foils may also be used.

Now referring to FIG. 6, hair foil 40 is shown as it would be after it has been prepared for use by brake 10 and then used by a hair colorist. Thus, hair foil 40 has been manually folded along crease line 42 and locked about hair section 44 and color product 46 painted onto hair section 44. Further understanding of this process will be had by referring to FIG. 7 which illustrates the use of brake 10 to prepare foil sheet 40 and then the subsequent steps in the process of this invention.

As shown in FIG. 7, brake 10 is first provided in an "open" or unfolded configuration as shown the upper left hand portion of FIG. 7. Next, as indicated by arrow 48, a pack 50 of hair foil sheets 40 is placed onto second and third triangles 16 and 18 with intended crease line 42 aligned with bending joint 30. Pack 50 can comprise one or more hair foil sheets 40, for example 20 or so sheets, so long as the number of sheets does not substantially interfere with the effectiveness of brake 10 to impart a crease into each sheet 40.

In accordance with the next step of the present invention and as indicated by arrow 52, first triangle 14 is folded about clamping joint or hinge 24 to lie on top of pack 50 to clampingly hold half of pack 50 between first and second triangles 14 and 16. Next, as indicated by arrow 54, third triangle 18 is folded along bending joint 30 to form creases 42 in each hair foil sheet 40 in pack 50. Removal of pack 50 from brake 10 is then begun as shown by arrow 56 illustrating unfolding third triangle 18 to an open configuration and then arrow 58 illustrating unfolding first triangle 14 to an open configuration with pack 50 of sheets 40 folded over folding edge 32 of first triangle 14.

Pack 50 of hair foil sheets 40 can then be removed from brake 10 as shown by arrow 60 and a single sheet 40 separated from pack 50, as illustrated by arrow 62 for use by a hair colorist. It will be understood that only three sheets 40 are illustrated for clarity but that one to twenty or even more sheets 40 will be suitably used. Furthermore, it is an advantage of the present invention that sheets 40 will tend to flare or slightly separate as shown in the figure so that manual selection of one sheet 40 for use will be facilitated, Thus, as illustrated by arrow 62 one foil sheet 40 is selected and then as indicated by arrow 64 is placed against hair section 44 which is to be colored. Then as illustrated by arrow 66, color product 46 is painted or otherwise applied to hair section 44. Finally, and as illustrated by arrow 68, hair foil 40 is folded along crease line 44 to lock triangular wings 70 and 72 about hair section 44 and color product 46.

Hair foils 40 are typically applied to a customer's head in horizontal, diagonal or vertical patterns to achieve different hair coloring effects. Thus, the colorist can take horizontal, diagonal or vertical slices or solid panels and/or can apply drips of color without weaving. The triangular shape of hair foils 40 with wings 70 and 72 when folded facilitates changing the foil's direction of placement to achieve different results and allows more control using less foil to achieve the results.

Figure 8:
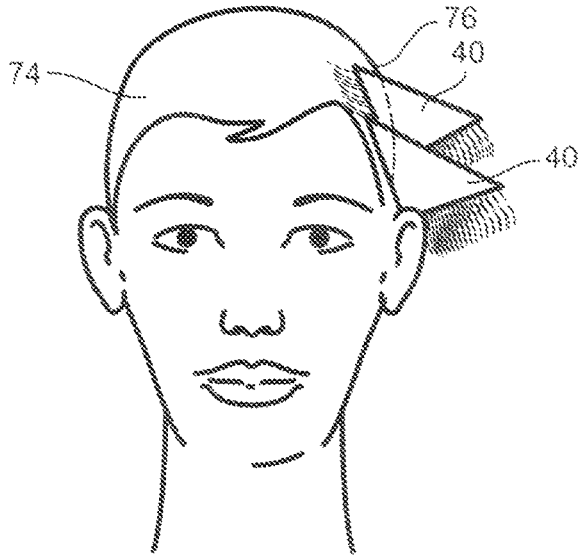
FIG. 8 is a front elevation view of a customer's head showing placement of triangular foils thereon in accordance with a preferred embodiment of a method of hair coloring of the present invention.
Figure 9:
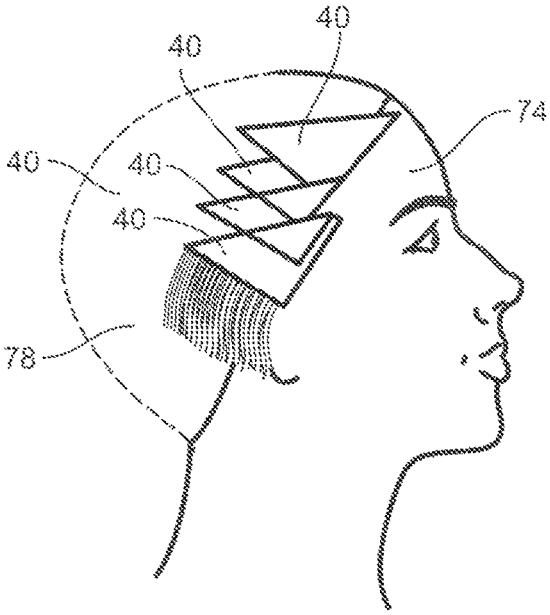
FIG. 9 is a left side elevation view of a customer's head showing placement of triangular foils thereon in accordance with a preferred embodiment of a method of hair coloring of the present invention.
Figure 10:
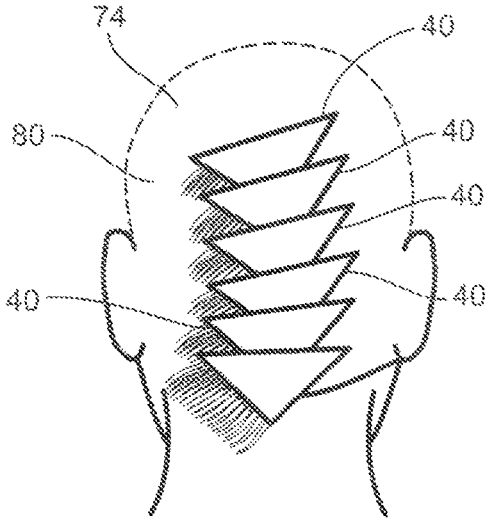
FIG. 10 is a rear elevation view of a customer's head showing placement of triangular foils thereon in accordance with a preferred embodiment of a method of hair coloring of the present invention.

Now referring to FIGS. 8 to 10, various placements of hair foils 40 on a customer's head 74 are illustrated. FIG. 8 illustrates hair foils 40 placed on left side 76 of a customer's head 74 with hair and coloring product neatly directed away from the customer's face. FIG. 9 illustrates hair foils 40 placed on the right side 78 of a customer's head 74 with hair and product directed away from the customer's face and showing a technique requiring less time to cover the foiling section. FIG. 10 illustrates hair foils 40 placed on the back 80 of a customer's head 74 and illustrates more head coverage than would be obtained with conventional square foils because of the relatively narrower width of hair foils 40. Of course, hair foils 40 can be rotated as needed to cover precise areas or obtain particular effects.

It is an advantage of the present invention that the triangular shape of the present foil requires only a single fold to lock the foil into place. Additionally, the triangular foils of the present invention allow for the treated hair section to be placed farther into the body of the foil, away from the foil crease, keeping the product on the selected section of hair and decreasing the possibility of uneven product saturation and product displacement that can result from the multiple folds of rectangular foils pushing the product away from the hair section, thereby avoiding what is known in the industry as lines of demarcation. Furthermore, by placing the crease of the triangular foils parallel to the temporal hairline, the packets of product and treated hair are kept out of the client's eyes and face as the packets are folded, closed and directed away from the face.

As illustrated in FIGS. 8 to 10, it is an advantage of the present invention that triangular hair foil packets are provided for use in the coloring process because triangular hair foils provide better coverage of the head.

It will be appreciated by those skilled in the art that the present invention is subject to modification and variation and it is intended that such modifications and variations are considered to be within the broad scope of the invention, which is intended to be limited only by the following claims.

What is claimed is:

1. A system for creasing hair foils for preparing hair foils for triangular dimensional hair color placement, the system comprising: at least one hair foil and a brake, the brake comprising in plan view, a sheet having first, second and third isosceles right triangles, each triangle having a pair of legs and a hypotenuse, one leg of said first triangle being hingedly joined to one leg of said second triangle to form a clamping joint and the hypotenuse of said second triangle being hingedly joined to the hypotenuse of said third to form a bending joint, said at least one hair foil lying substantially on, and in parallel planar relationship to, said second and third triangles hingedly joined to form said bending joint.

2. A system as in claim 1, wherein said sheet comprises a polymeric material and said joints are live hinges.

3. A system as in claim 2, wherein said sheet has a folding edge which is a hypotenuse of said first right triangle and which carries a series of teeth.

4. A system as in claim 2, wherein said bending joint has a plurality of spaced apart projections.

5. A system as in claim 2, wherein said triangles are congruent.

6. A system for creasing hair foils for preparing hair foils for triangular dimensional hair color placement, the system comprising: at least one hair foil and a brake, the brake comprising in plan view, a sheet having first, second and third isosceles right triangles, each triangle having a pair of legs and a hypotenuse, one leg of said first triangle being hingedly joined along a first single axis to one leg of said second triangle to form a clamping joint and the hypotenuse of said second triangle being hingedly joined along a second single axis to the hypotenuse of said third triangle to form a bending joint, said at least one hair foil lying substantially on, and in parallel planar relationship to, said second and third triangles hingedly joined to form said bending joint.

7. A system as in claim 6 wherein said first triangle is bendable about said first single axis to overlie said second triangle and said third triangle is subsequently bendable about said second single axis to overlie said first triangle.

8. A system as in claim 7, wherein said sheet consists essentially of a polymeric material and said joints are live hinges.

* * * * *